US007139700B1

(12) United States Patent
Stachurski et al.

(10) Patent No.: US 7,139,700 B1
(45) Date of Patent: Nov. 21, 2006

(54) HYBRID SPEECH CODING AND SYSTEM

(75) Inventors: Jacek Stachurski, Dallas, TX (US); Alan V. McCree, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1215 days.

(21) Appl. No.: 09/668,846

(22) Filed: Sep. 22, 2000

Related U.S. Application Data

(60) Provisional application No. 60/155,517, filed on Sep. 22, 1999, provisional application No. 60/155,439, filed on Sep. 22, 1999, provisional application No. 60/155,438, filed on Sep. 22, 1999.

(51) Int. Cl.
*G10L 19/02* (2006.01)
*G10L 19/04* (2006.01)
*G10L 11/06* (2006.01)

(52) U.S. Cl. ..... 704/207; 704/208; 704/221

(58) Field of Classification Search ..... 704/201, 704/207, 208, 219, 220, 221, 223, 222, 203
See application file for complete search history.

(56) References Cited

U.S. PATENT DOCUMENTS 4,963,034 A * 10/1990 Cuperman et al. ..... 704/222
5,027,405 A * 6/1991 Ozawa ..... 704/223
5,195,137 A * 3/1993 Swaminathan ..... 704/222
5,455,888 A * 10/1995 Iyengar et al. ..... 704/203
5,517,595 A * 5/1996 Kleijn ..... 704/205
5,806,037 A * 9/1998 Sogo ..... 704/268
5,864,795 A * 1/1999 Bartkowiak ..... 704/216
6,014,618 A * 1/2000 Patel et al. ..... 704/207
6,138,092 A * 10/2000 Zinser et al. ..... 704/223
6,233,550 B1 * 5/2001 Gersho et al. ..... 704/208
6,470,309 B1 * 10/2002 McCree ..... 704/207
6,475,245 B1 * 11/2002 Gersho et al. ..... 704/208
6,640,209 B1 * 10/2003 Das ..... 704/219
6,691,082 B1 * 2/2004 Aguilar et al. ..... 704/219

OTHER PUBLICATIONS

Haagen et al., "Improvements in 2.4 kbps high-quality speech coding," 1992 IEEE International Conference on Acoustics, Speech, and Signal Processing, Mar. 23-26, 1992, vol. 2, pp. 145 to 148.*
Y. Shoham, "High-quality speech coding at 2.4 to 4.0 kbit/s based on time-frequency interpolation," 1993 IEEE International Conference on Acoustics, Speech, and Signal Processing, Apr. 27-30, 1993, vol. 2, pp. 167 to 170.*

* cited by examiner

*Primary Examiner*—Martin Lerner
(74) *Attorney, Agent, or Firm*—Carlton H. Hoel; W. James Brady; Frederick J. Telecky, Jr.

(57) ABSTRACT

Linear predictive speech coding system with classification of frames and a hybrid coder using both waveform coding and parametric coding for different classes of frames. Phase alignment for a parametric coder aligns synthesized speech frames with adjacent waveform coder synthesized frames. Zero phase alignment of speech prior to waveform coding aligns synthesized speech frames of a waveform coder with frames synthesized with a parametric coder. Inter-frame interpolation of LP coefficients suppresses artifacts in resultant synthesized speech frames.

6 Claims, 5 Drawing Sheets

HYBRID SPEECH CODING AND SYSTEM

CROSS-REFERENCE TO RELATED APPLICATIONS

This application claims priority from provisional applications: Serial Nos. 60/155,517, 60/155,439, and 60/155,438, all filed Sep. 22, 1999.

BACKGROUND OF THE INVENTION

The invention relates to electronic devices, and, more particularly, to speech coding, transmission, storage, and synthesis circuitry and methods.

The performance of digital speech systems using low bit rates has become increasingly important with current and foreseeable digital communications. One digital speech method, linear prediction (LP), models the vocal track as a filter with excitation to mimic human speech. In this approach only the parameters of the filter and the excitation of the filter are transmitted across the communication channel (or stored), and a synthesizer regenerates the speech with the same perceptual characteristics as the input speech. Periodic updating of the parameters requires fewer bits than direct representation of the speech signal, so a reasonable LP vocoder can operate at bits rates as low as 2–3 Kb/s (kilobits per second), whereas the public telephone system uses 64 Kb/s (8-bit PCM codewords at 8,000 samples per second). See for example, McCree et al, A 2.4 Kbit/s MELP Coder Candidate for the New U.S. Federal Standard, Proc. IEEE ICASSP 200 (1996) and U.S. Pat. No. 5,699,477.

The speech signal can be roughly divided into voiced and unvoiced regions. The voiced speech is periodic with a varying level of periodicity. The unvoiced speech does not display any apparent periodicity and has a noisy character. Transitions between voiced and unvoiced regions as well as temporary sound outbursts (e.g., plosives like "p" or "t") are neither periodic nor clearly noise-like. In low-bit rate speech coding, applying different techniques to various speech regions can result in increased efficiency and perceptually more accurate signal representation. In coders which use linear prediction, the linear LP-synthesis filter is used to generate output speech. The excitation of the LP-synthesis filter models the LP-analysis residual which maintains speech characteristics: it is periodic for voiced speech, noise-like for unvoiced segments, and neither for transitions or plosives. In the Code Excited Linear Prediction (CELP) coder, the LP excitation is generated as a sum of a pitch synthesis-filter output (sometimes implemented as an entry in an adaptive codebook) and an innovation sequence. The pitch-filter (adaptive codebook) models the periodicity of the voiced speech. The unvoiced segments are generated from a fixed codebook which contains stochastic vectors. The codebook entries are selected based on the error between input (target) signal and synthesized speech making CELP a waveform coder. T. Moriya and M. Honda "Seech Coder Using Phase Equalization and Vector Quantization", Proc. IEEE ICASSP 1701 (1986), describe a phase equalization filtering to take advantage of perceptual redundancy in slowly varying phase characteristics and thereby reduce the number of bits required for coding.

Sub-frame pitch and multistage vector quantization is described in A. McCree and J. DeMartin, "A 1.7 kb/s MELP Coder with Improved Analysis and Quantization", Proc. IEEE ICASSP 593–596 (1998).

In the Mixed Excitation Linear Prediction (MELP) coder, the LP excitation is encoded as a superposition of periodic and non-periodic components. The periodic part is generated from waveforms, each representing a pitch period, encoded in the frequency domain. The non-periodic part consists of noise generated based on signal correlations in individual frequency bands. The MELP-generated voiced excitation contains both (periodic and non-periodic) components while the unvoiced excitation is limited to the non-periodic component. The coder parameters are encoded based on an error between parameters extracted from input speech and parameters used to synthesize output speech making MELP a parametric coder. The MELP coder, like other parametric coders, is very good at reconstructing the strong periodicity of steady voiced regions. It is able to arrive at a good representation of a strongly periodic signal quickly and well adjusts to small variations present in the signal. It is, however, less effective at modeling aperiodic speech segments like transitions, plosive sounds, and unvoiced regions. The CELP coder, on the other hand, by matching the target waveform directly, seems to do better than MELP at representing irregular features of speech. It is capable of maintaining strong signal periodicity but, at low bit-rates, it takes CELP longer to "build up" a good representation of periodic speech. The CELP coder is also less effective at matching small variations of strongly periodic signals.

These observations suggest that using both CELP and MELP (waveform and parametric) coders to a represent speech signal would provide many benefits as each coder seems to be better at representing different speech regions. The MELP coder might be most effectively used in periodic regions and the CELP coder might be best for unvoiced, transitions, and other nonperiodic segments of speech. For example, D. L. Thomson and D. P. Prezas, "Selective Modeling of the LPC Residual During Unvoiced Frames; White Noise or Pulse Excitation," Proc. IEEE ICASSP, (Tokyo), 3087–3090 (1986) describes an LPC vocoder with a multipulse waveform coder, W. B. Kleijn, "Encoding Speech Using Prototype Waveforms," 1 IEEE Trans.Speech and Audio Proc., 386–399 (1993) describes a CELP coder with the Prototype Waveform Interpolation coder, and E. Shlomot, V. Cuperman, and A. Gersho, "Combined Harmonic and Waveform Coding of Speech at Low Bit Rates," Proc. IEEE ICASSP (Seattle), 585–588 (1998) describes a CELP coder with a sinusoidal coder.

Combining a parametric coder with a waveform coder generates problems of making the two work together. In known methods, the initial phase (time-shift) of the parametric coder is estimated based on past samples of the synthesized signal. When the waveform coder is to be used, its target-vector is shifted based on the drift between synthesized and input speech. The solution works well for some types of input but it is not robust: it may easily break when the system attempts to switch frequently between coders, particularly in voiced regions.

In short, the speech output from such hybrid vocoders at about 4 kb/s is yet not an acceptable substitute for toll-quality speech in many applications.

SUMMARY OF THE INVENTION

The present invention provides a hybrid linear predictive speech coding system and method which has some periodic frames coded with a parametric coder and some with a waveform coder. In particular, various preferred embodiments provide one or more features such as coding weakly-voiced frames with waveform coders and strongly-voiced frames with parametric coders; parametric coding for the strongly-voiced frames may include amplitude-only waveforms plus an alignment phase to maintain time synchrony; zero-phase equalization filtering prior to waveform coding helps avoid phase discontinuities at interfaces with parametric coded frames; and interpolation of parameters within a frame for the waveform coder enhances performance.

These features each has advantages including a low-bit-rate hybrid coder using the voicing of weakly-voiced frames to enhance the waveform coder and avoiding phase discontinuities at the switching between parametric and waveform coded frames.

BRIEF DESCRIPTION OF THE DRAWINGS

The drawings are heuristic for clarity.

DESCRIPTION OF THE PREFERRED EMBODIMENTS

Overview

Figure 1A:
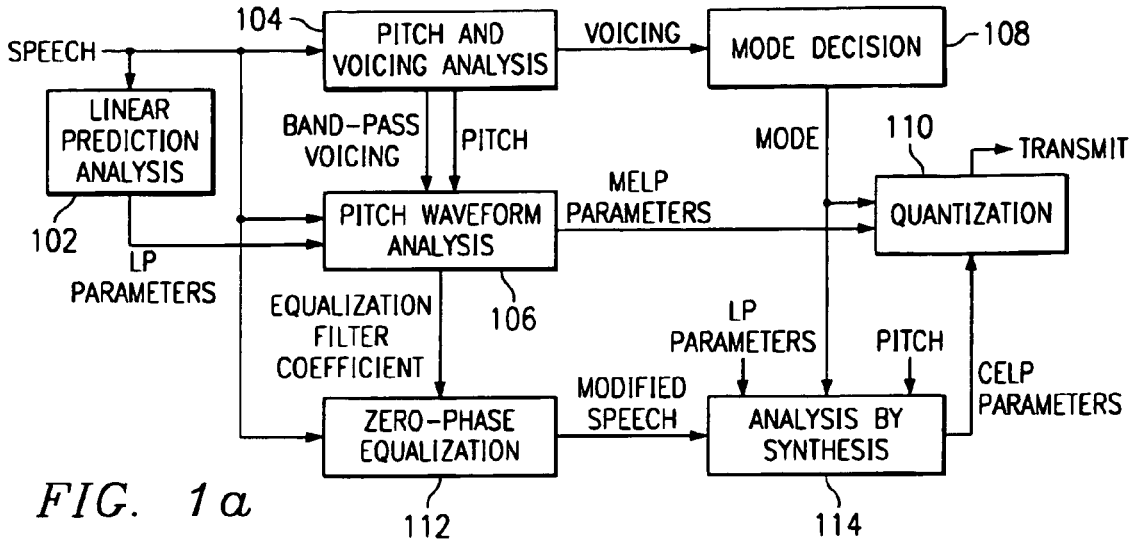
FIGS. 1*a*–1*d* show as functional blocks a preferred embodiment system with coder and decoder.
Figure 1B:
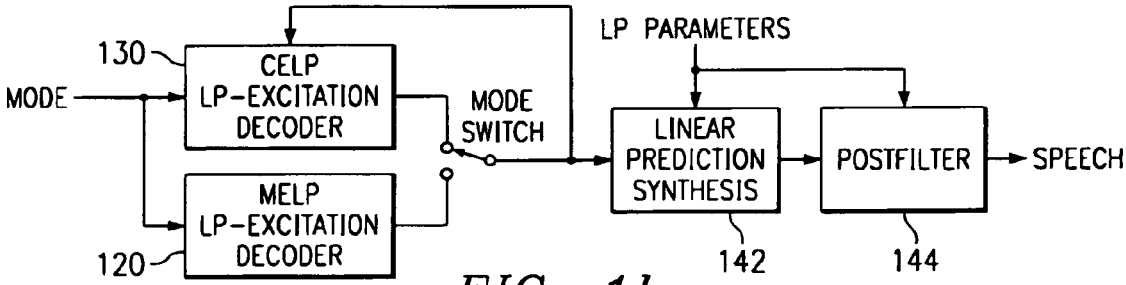

Preferred embodiments provide hybrid digital speech coding systems (coders and decoders) and methods which combine the CELP model (waveform coding) with the MELP technique (parametric coding) in which weakly-periodic frames are coded with a CELP coder rather than a MELP coder. Such hybrid coding may be effectively used at bit rates about 4 kb/s. FIGS. 1*a*–1*b* show a first preferred embodiment system in functional block format with the coder in FIG. 1*a* and decoder in FIG. 1*b*.

The preferred embodiment coder of FIG. 1*a* operates as follows. Input digital speech (sampling rate of 8 kHz) is partitioned into 160-sample frames. Linear Prediction Analysis 102 performs standard linear prediction (LP) analysis using a Hamming window of 200 samples centered at the end of a 160-sample frame (thus extending into the next frame). The LP parameters are calculated and transformed into line spectral frequency (LSF) parameters.

Pitch and Voicing Analysis 104 estimates the pitch for a frame from a low-pass filtered version of the frame. Also, the frame is filtered into five frequency bands and in each band the voicing level for the frame is estimated based on correlation maxima. An overall voicing level is determined.

Pitch Waveform Analysis 106 extracts individual pitch-pulse waveforms from the LP residual every 20 samples (sub-frames) which are transformed into the frequency domain with a discrete Fourier transform. The waveforms are normalized, aligned, and averaged in the frequency domain. Zero-phase equalization filter coefficients are derived from the averaged Fourier coefficients. The Fourier magnitudes are taken from the smoothed Fourier coefficients corresponding to the end of the frame. The gain of the waveforms is smoothed with a median filter and down-sampled to two values per frame. The alignment phase is estimated once per frame based on the linear phase used to align the extracted LP-residual waveforms. This phase is used in the MELP decoder to preserve time synchrony between the synthesized and input speech. This time synchronization reduces switching artifacts between MELP and CELP coders.

Mode Decision 108 classifies each frame of input speech into one of three classes: unvoiced, weakly-voiced, and strongly-voiced. The frame classification is based on the overall voicing strength determined in the Pitch and Voicing Analysis 104. Classify a frame with very weak voicing or when no pitch estimate is made as unvoiced, a frame in which a pitch estimate is not reliable or changes rapidly or in which voicing is not strong as weakly-voiced, and a frame for which voicing is strong and the pitch estimate is steady and reliable as strongly-voiced. For strongly-voiced frames, MELP quantization is performed in Quantization 110. For weakly-voiced frames, the CELP coder with pitch predictor and sparse codebook is employed. For unvoiced frames, the CELP coder with stochastic codebook (and no pitch predictor) is used. This classification focuses on using the periodicity of weakly-voiced frames which are not effectively parametrically coded to enhance the waveform coding by using a pitch predictor so the pitch-filter output looks more stochastic and may use a more effective codebook.

When the MELP coder is used, pitch-pulse waveforms are encoded as Fourier magnitudes only (although alignment phase may be included), and the MELP parameters quantized in Quantization 110.

In the CELP mode, the target waveform is matched in the (weighted) time domain so that, effectively, both amplitude and phase are coded. To limit switching artifacts between amplitude-only MELP and amplitude-and-phase CELP coding, Zero-Phase Equalization 112 modifies the CELP target vector to remove the signal phase component not coded in MELP. The zero-phase equalization is implemented in the time domain as an FIR filter. The filter coefficients are derived from the smoothed pitch pulse waveforms.

Analysis by Synthesis 114 is used by the CELP coder for weakly-voiced frames to encode the pitch, pitch-predictor gain, fixed-codebook contribution, and codebook gain. The initial pitch estimate is obtained from the pitch-and-voicing analysis. The fixed codebook is a sparse codebook with four pulses per 10 ms (80-sample) sub-frame. The pitch-predictor gain and the fixed excitation gain are quantized jointly by Quantization 110.

For unvoiced frames, the CELP coder encodes the LP-excitation using a stochastic codebook with 5 ms (40-sample) sub-frames. Pitch prediction is not used in this mode. For both weakly-voiced and unvoiced frames, the target waveform for the analysis-by-synthesis procedure is the zero-phase-equalized speech from Zero-Phase Equalization 112. For frames for which the MELP coder is chosen, the MELP LP-excitation decoder is run to properly maintain the pitch delay buffer and the analysis-by-synthesis filter memories.

Figure 1C:
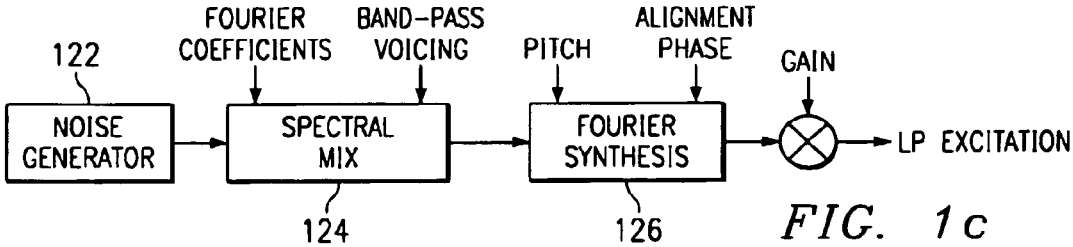

The preferred embodiment decoder of FIG. 1*b* operates as follows. In the MELP LP-Excitation Decoder 120 (details in FIG. 1*c*) the Fourier magnitudes are mixed with spectra obtained from white noise out of Noise Generator 122. The relative signal references in Spectral Mix 124 is determined by the bandpass voicing strengths. Fourier Synthesis 126 uses the mixed Fourier spectra, pitch, and alignment phase to synthesize a time-domain signal. The gain scaled time-domain signal forms the MELP LP-excitation.

Figure 1D:
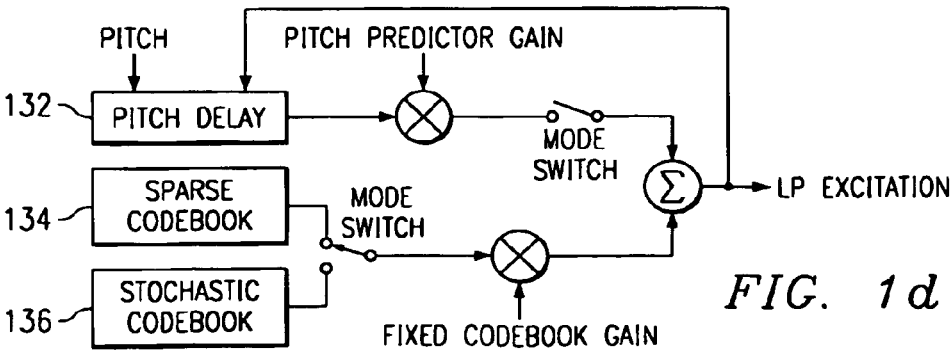

CELP LP-Excitation decoder 130 has blocks as shown in FIG. 1*d*. In weakly-voiced mode, scaled samples of the past LP excitation from Pitch Delay 132 are summed with the scaled pulse-codebook contribution from Sparse Codebook 134. In the unvoiced mode, scaled Stochastic Codebook 136 entries form the LP-excitation.

The LP excitation is passed through a Linear Prediction Synthesis 142 filter. The LP filter coefficients are decoded from the transmitted MELP or CELP parameters, depending upon the mode. The coefficients are interpolated in the LSF domain with 2.5 ms (20-sample) sub-frames.

Postfilter 144 with coefficients derived from LP parameters provides enhanced formant peaks.

The bit allocations for preferred embodiment coders for a 4 kb/s system (80 bits per 20 ms, 160-sample frame) could be:

| Parameter | MELP | CELP |
|---|---|---|
| LP coefficients | 24 | 19 |
| Gain | 8 | 5 |
| Pitch | 8 | 5 |
| Alignment phase | 6 | — |
| Fourier magnitudes | 22 | — |
| Voicing level | 6 | — |
| Fixed codebook | — | 44 |
| Codebook gain | — | 5 |
| Reserved | 3 | — |
| MELP/CELP flag | 1 | 1 |
| Parity bits | 2 | 1 |

In particular, the LP parameters are coded in the LSF domain with 24 bits in a MELP frame and 19 bits in a CELP frame. Switched predictive multi-stage vector quantization is used. The same two codebooks, one weakly predictive and one strongly predictive, are used by both coders with one bit encoding the selected codebook. Each codebook has four stages with the bit allocation of 7, 6, 5, 5. The MELP coder uses all four stages, while the CELP coder uses only the first three stages.

In the MELP coder, the gain corresponding to a frame end is encoded with 5 bits, and the mid-frame gain is coded with 3 bits. The coder uses 8 bits for pitch and 6 bits for alignment phase. The Fourier magnitudes are quantized with switched predictive multistage vector quantization using 22 bits. Bandpass voicing is quantized with 3 bits twice per frame.

In the CELP coder, one gain for a frame is encoded with 5 bits. The pitch lag is encoded with 5 bits; one codeword is reserved to indicate CELP in unvoiced mode. In weakly-voiced mode, the CELP coder uses a sparse codebook with four pulses for each 10 ms, 80-sample sub-frame, eight pulses per 20 ms frame. A pulse is limited to a 20-sample subset of the 80 sample positions in a sub-frame; for example, a first pulse may occur in the subset of positions which are numbered as multiples of 4, a second pulse in the subset of positions which are numbered as multiples of 4 plus 1, and so forth for the third and fourth pulses. Two pulses with corresponding signs are jointly coded with 11 bits. All eight pulses are encoded with 44 bits. Two pitch prediction gains and two normalized fixed-codebook gains are jointly quantized with 5 bits per frame. In unvoiced mode, the CELP coder uses a stochastic codebook with 5 ms (40-sample) sub-frames which means four per frame; 10-bit codebooks with one sign bit are used for the total of 44 bits per frame. The four stochastic-codebook gains normalized by the overall gain are vector-quantized with 5 bits.

One bit is used to encode MELP/CELP selection. One overall parity bit protecting 12 common CELP/MELP bits and one parity bit protecting additional 11 MELP bits are used.

The strongly-voiced frames coded with a MELP coder have an LP-excitation as a mixture of periodic and non-periodic MELP components with the first being the dominant. The periodic part is generated from waveforms encoded in the frequency domain, each representing a pitch period. The non-periodic part is a frequency-shaped random noise. The noise shaping is estimated (and encoded) based on signal correlation-strengths in five frequency bands.

Alternative preferred embodiment hybrid coders apply zero-phase equalization to the LP residual rather than to the input speech; and some preferred embodiments omit the zero-phase equalization.

Further alternative preferred embodiments connect MELP and CELP frames without the alignment phase preservation of time-synchrony between the input speech and the synthesized speech; but rather rely on zero-phase equalization of CELP inputs or ignore the alignment problem altogether and rely only on the frame classification.

Further preferred embodiments extend the frame classification of the previously-described preferred embodiments and split the class of weakly-voiced frames into two sub-classes: one with increased number of bits allocated to encode the periodic component (pitch predictor) and the other with larger number of bits assigned to code the non-periodic component. The first sub-class (more bits for the periodic component) could be used when the pitch changes irregularly; increased number of bits to encode the pitch could follow the pitch track more accurately. The second sub-class (more bits for the non-periodic component) could be used for voice onsets and regions with irregular energy spikes.

Further preferred embodiments include non-hybrid coders. Indeed, a CELP coder with frame classification to voiced and nonvoiced can still use pitch predictor and zero-phase equalization. The zero-phase equalization filtering could be used to sharpen pulses, and the filter coefficients derived in the preferred embodiment method of pitch period residuals and frequency domain filter coefficient determinations.

Likewise, other preferred embodiment CELP coders could employ the LP filter coefficients interpolation within excitation frames.

Similarly, further preferred embodiment MELP coders could use the alignment phase with the alignment phase derived in the preferred embodiment method as the difference between of two other estimated phases related to the alignment of a waveform to its smoothed, aligned preceding waveforms and the alignment of the smoothed, aligned preceding waveforms to amplitude-only versions of the waveforms.

Figure 7:
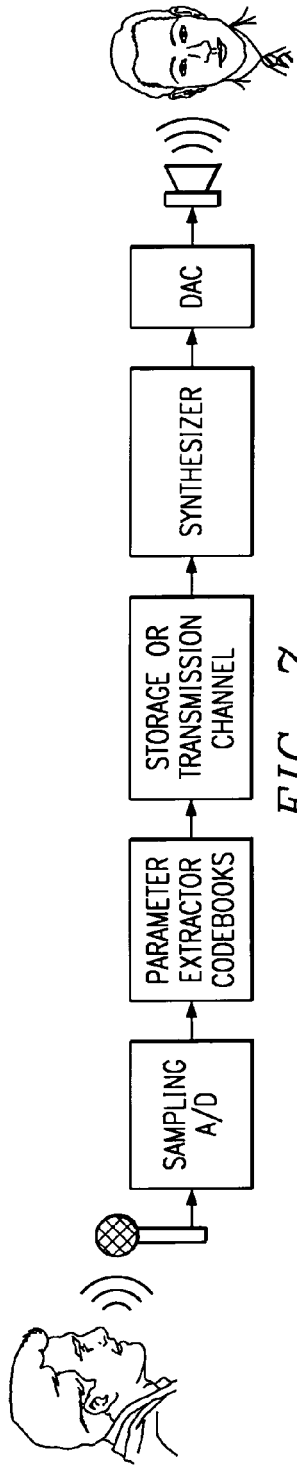
FIG. 7 shows a system in block format.

FIG. 7 illustrates an overall system. The encoding (and decoding) may be implemented with a digital signal processor (DSP) such as the TMS320C30 or TMS320C6xxx manufactured by Texas Instruments which can be programmed to perform the analysis or synthesis essentially in real time.

The following sections provide more details.

MELP and CELP models

Linear Prediction Analysis determines the LPC coefficients a(j)=1, 2, . . . M, for an input frame of digital speech samples {y(n)} by setting $$e(n)=y(n)-\Sigma_{M\geq j\geq 1}a(j)y(n-j) \quad (1)$$

and minimizing $\Sigma e(n)^2$. Typically, M, the order of the linear prediction filter, is taken to be about 10–12; the sampling rate to form the samples y(n) is taken to be 8000 Hz (the same as the public telephone network sampling for digital transmission); and the number of samples {y(n)} in a frame is often 160 (a 20 msec frame) or 180 (a 22.5 msec frame). A frame of samples may be generated by various windowing operations applied to the input speech samples. The name "linear prediction" arises from the interpretation of $e(n)=y(n)-\Sigma_{M\geq j\geq 1}a(j)y(n-j)$ as the error in predicting y(n) by the linear sum of preceding samples $\Sigma_{M\geq j\geq 1}a(j)y(n-j)$. Thus minimizing $\Sigma e(n)^2$ yields the {a(j)} which furnish the best linear prediction. The coefficients {a(j)} may be converted to LSFs for quantization and transmission.

The {e(n)} form the LP residual for the frame and ideally would be the excitation for the synthesis filter 1/A(z) where A(z) is the transfer function of equation (1). Of course, the LP residual is not available at the decoder; so the task of the encoder is to represent the LP residual so that the decoder can generate the LP excitation from the encoded parameters.

The Band-Pass Voicing for a frequency band (typically two to five bands, such as 0–500 Hz, 500–1000 Hz, 1000–2000 Hz, 2000–3000 Hz, and 3000–4000 Hz) determines whether the LP excitation derived from the LP residual {e(n)} should be periodic (voiced) or white noise (unvoiced) for a particular band.

The Pitch Analysis determines the pitch period (smallest period in voiced frames) by low pass filtering {y(n)} and then correlating {y(n)} with {y(n+m)} for various m; the m with maximal correlation provides an integer pitch period estimate. Interpolations may be used to refine an integer pitch period estimate to pitch period estimate using fractional sample intervals. The resultant pitch period may be denoted pT where p is a real number, typically constrained to be in the range 18 to 132 (corresponding to pitch frequencies of 444 to 61 Hz), and T is the sampling interval of ⅛ millisecond. Thus p is the number of samples in a pitch period. The LP residual {e(n)} in voiced bands should be a combination of pitch-frequency harmonics. Indeed, an ideal impulse excitation would be described with all harmonics having equal real amplitudes.

Fourier Coefficient Estimation leads to coding of the Fourier transform of the LP residual for voiced bands; MELP typically only codes the amplitudes of the Fourier coefficients.

Gain Analysis sets the overall energy level for a frame.

Spectra of the residual

Figure 2A:
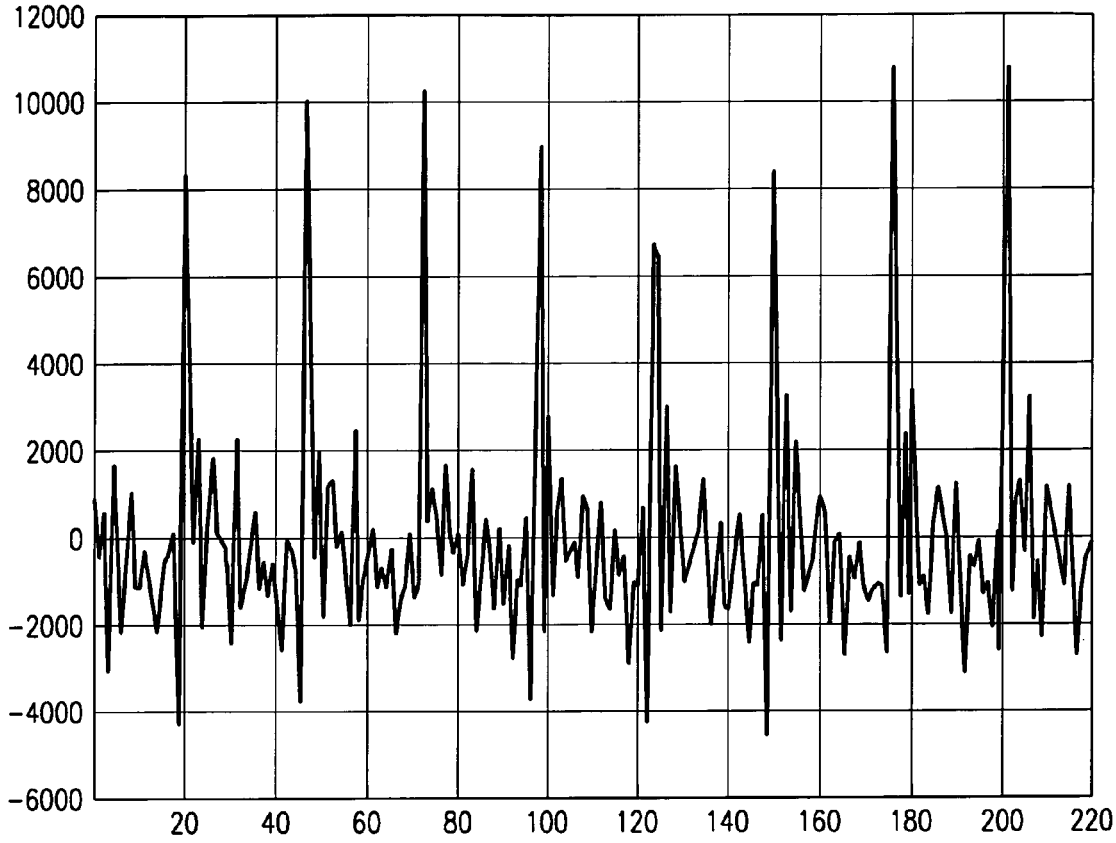
FIGS. 2*a*–2*b* illustrate a residual and waveform.

FIG. 2*a* illustrates an LP residual {e(n)} for a voiced frame and includes about eight pitch periods with each pitch period about 26 samples. For a voiced frame with pitch period equal to pT, the Fourier coefficients peak about 1/pT, 2/pT, 3/pT, . . . k/pT, . . . ; that is, at the fundamental frequency (first harmonic) 1/pT and the higher harmonics. Of course, p need not be an integer, and the magnitudes of the Fourier coefficients at the harmonics, denoted X[1], X[2], . . . , X[k], . . . must be estimated. These estimates will be quantized, transmitted, and used by the decoder to create the LP excitation.

Figure 2B:
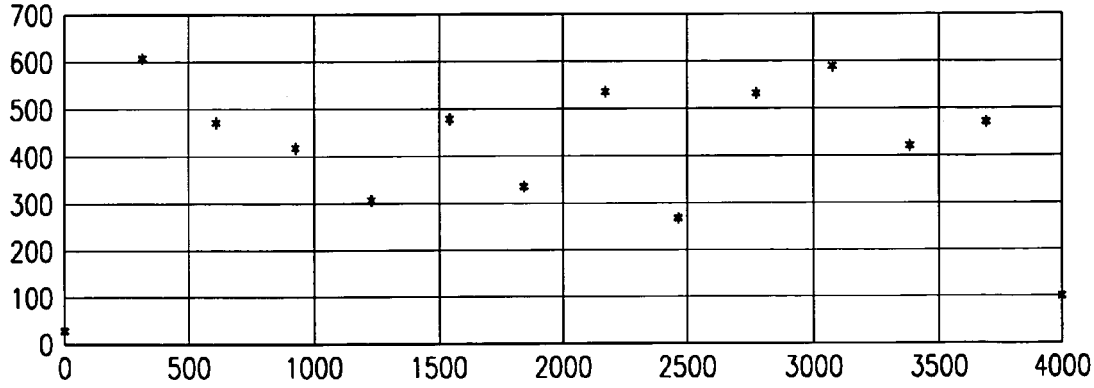

The {X[k]} may be estimated by applying a discrete Fourier transform to the samples of a single period (or small number of periods) of e(n) as in FIGS. 2*a*–2*b*. The preferred embodiment only uses the magnitudes of the Fourier coefficients, although the phases could also be used. Because the LP residual components {e(n)} are real, the discrete Fourier transform coefficients {X(k)} are conjugate symmetric: $X(k)=X^*(N-k)$ for an N-point discrete Fourier transform. Thus only half of the {X(k)} need be used for magnitude considerations. Of course, with a pitch period of p samples, N will be an integer equal to [p] or [p]+1.

Codebooks for Fourier coefficients

Once the estimated magnitudes of the Fourier coefficients X[k] for the fundamental pitch frequency and higher harmonics have been found, they must be transmitted with a minimal number of bits. The preferred embodiments use vector quantization of the spectra. That is, treat the set of Fourier coefficient magnitudes (amplitudes) |X[1]|, |X[2]|, . . . |X[k]|, . . . as a vector in a multi-dimensional quantization, and transmit only the index of the output quantized vector. Note that there are [p] or [p]+1 coefficients, but only half of the components are significant due to their conjugate symmetry. Thus for a short pitch period such as pT=4 milliseconds (p=32), the fundamental frequency 1/pT (=250 Hz) is high and there are 32 harmonics, but only 16 would be significant (not counting the DC component). Similarly, for a long pitch period such as pT=12 milliseconds (p=96), the fundamental frequency (=83 Hz) is low and there are 48 significant harmonics.

In general, the set of output quantized vectors may be created by adaptive selection with a clustering method from a set of input training vectors. For example, a large number of randomly selected vectors (spectra) from various speakers can be used to form a codebook (or codebooks with multi-step vector quantization). Thus a quantized and coded version of an input spectrum X[1], X[2], . . . X[k], . . . can be transmitted as the index in the codebook of the quantized vector.

Frame classification

Classify frames as follows. Initially look for speech activity in an input frame (such as by energy level exceeding a threshold): if there is no speech activity, classify the frame as unvoiced. Otherwise, put each frame of input speech into one of three classes: unvoiced (UV_MODE), weakly-voiced (WV_MODE), and strongly-voiced (SV_MODE). The classification is based on the estimated voicing strength and pitch. For very weak voicing, when no pitch estimate is made, a frame is classified as unvoiced. A frame in which the voicing is weak or in which the voicing is strong but the pitch estimate is not reliable or changes rapidly is classified as weakly-voiced. A frame for which voicing is strong, and the pitch estimate is steady and reliable, is classified as strongly-voiced.

In more detail, proceed as follows (1) digitize and sample input speech and partition into frames (typically 160 samples per frame), (2) apply speech activity detection to each of the eight 20-sample sub-frames of the frame; the speech activity detection may be by the sum of squares of samples with a threshold.

(3) compute linear prediction coefficients using a 200-sample window centered at the end of the frame. The LP coefficients are used in both MELP and CELP coders.

(4) extract an LP residual for each of two 80-sample sub-frames by filtering with the linear prediction analysis filter.

(5) determine the peakiness ("peaky") of the residuals by the ratio of the average squared sample to the average absolute sample squared; for white noise (unvoiced excitation) the ratio is about π/2, whereas for periodicity (voiced excitation) the ratio is much larger.

(6) lowpass filter the frame prior to pitch extraction; human speech pitch typically falls in the range of roughly 444 Hz down to 61 Hz (corresponding to pitch periods of 18 to 132 samples) with the adult males clustering in the lower portion of the range and children and adult females clustering in the upper portion.

(7) extract pitch estimates from a 264-sample interval which corresponds to the input frame plus 104 samples from adjacent frames as follows. First partition the 264 samples into six 44-sample pitch sub-frames and extract four pitch estimates for each sub-frame by maximizing cross-correlations of pairs of 44-sample length intervals with one interval being the sub-frame and the other interval being offset by a possible pitch estimate and multiplied by one of four adjustment factors. The adjustment factors (indexed 0, 1, 2, and 3) may depend upon pitch as detailed in the next item; the 0-th factor is taken equal to 1.

(8) for k=0, 1, 2, and 3 linearly combine the six pitch estimates having the k-th adjustment factor to yield the k-th pitch candidate: fpitch[k]. The linear combination uses weights proportional to the corresponding maximum cross-correlations for the corresponding sub-frame. The adjustment factor for fpitch[0] is 1, the factor for fpitch[1] is 1−|pitch−previous_pitch|/previous_pitch, the factor for fpitch[2] is linear decay with pitch period and the factor for fpitch[3] is also linear decay with pitch period but with smaller slope.

(9) select the best among the three pitch candidates fpitch[1], fpitch[2], and fpitch[3] using the closeness of the pitch candidate to the pitch estimate of the immediately preceding frame as the criterion.

(10) compare the sum over the six 44-sample sub-frames of maximum cross-correlations of fpitch[0] and fpitch[1] by using the previous pitch estimates for sub-frames but with both adjustment factors equal to 1. If the sub-frame sum of maximum cross-correlations for fpitch[1] exceeds 64% of the subframe sum of for fpitch[0], and if fpitch[1] exceeds fpitch[0] by at least 5%, then exchange fpitch[0] and fpitch[1] plus exchange the corresponding sub-frame sums of maximum cross-correlation sums and best pitch. Note that fpitch[1] exceeding fpitch[0] by at least 5% means fpitch[1] is a significantly lower fundamental frequency and would take care of the case that fpitch[0] were really a second harmonic.

(11) filter the input speech frame into five frequency bands (0–500 Hz, 500–1000 Hz, 1000–2000 Hz, 2000–3000 Hz, and 3000–4000 Hz). For each frequency band again use the partitioning into six 44-sample subframes with each subframe having four pitch estimates as in the preceding fpitch[] candidates derivation. Then for k=0,1,2,3 and j=1,2,3,4,5 compute the j-th bandpass correlation bpcorr[j,k] as the sum over subframes of cross-correlations using the k-th pitch estimate (omitting any adjustment factor).

—for the j-th band define a bandpass voicing level bpvc[j] as bpcorr[j,0]. Plus for the k-th pitch candidate define a pitch correlation pcorr[k] as the sum over the six bands of the bpcorr[j,k] but only including bpcorr[j,k] if bpcorr[j,0] (=bpvc[j]) exceeds a threshold of 0.8.

Figure 3:
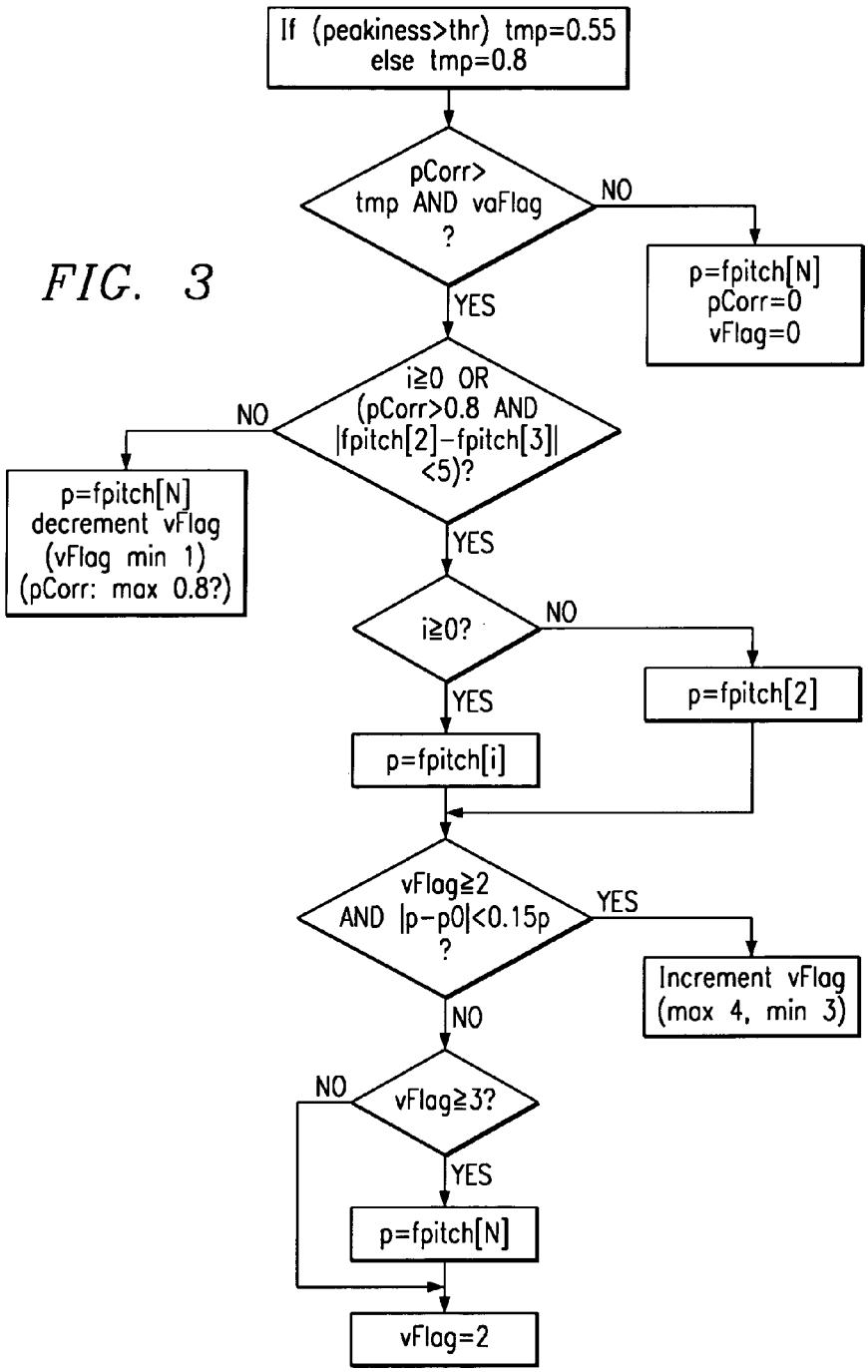
FIG. 3 shows frame classification.

(12) pick the pitch candidate as follows (compare FIG. 3): if pcorr[0] is less than 4*threshold, then put i=−1; if pcorr[0] is at least 4*threshold, then i=0 unless pcorr[k] is at least 0.8*pcorr[0], then take i=the largest such k unless additionally pcorr[k] is less than 0.9*pcorr[0] in which case take i=−1.

```
/* Correct pitch path */
  if (vFlag>V_WEAK ||peaky>PEAK_THRESH) tmp=0.55;
  else tmp=0.8;
  if (pCorr>tmp && vaFlag ){
    if (i>=0||(pCorr>0.8 && abs(fpitch[2]−fpitch[3])<5.0)){
      /* Strong pitch estimate for current frame */
      if(i>=0)
        /* Bandpass voicing: choose pitch from bandpass voicing */
        p=fpitch[i];
      else
        /* Reasonable correlation and unambiguous pitch */
        p=fpitch[2];
      if (vFlag>=V_MARG && abs(p−p0)<0.15*p){
        /* Good pitch track: strong estimate */
        vFlag++;
        if (vFlag>V_MAX)
          vFlag=V_MAX;
        if (vFlag<V_STRONG)
          vFlag=V_STRONG;
      }
      else {
        if (vFlag>=V_STRONG)
          /* Use pitch tracking */
          p=fpitch[N]; //this is the find_pit return N=best_pitch
          /* Force marginal estimate */
          vFlag=V_MARG;
        }
      }
      else {
        /* Weak estimate: use pitch tracking */
        p=fpitch[N];
        vFlag—;
        vFlag=max (V_WEAK, vFlag);
        pCorr=min (VSTRONG_COR_COR−0.01, pCorr);
      }
    }
    else {
    /* Force unvoiced if weak pitch correlation */
    p=fpitch[N]; /* keep using pitch tracking */
    pcorr =0.0;
    vFlag=V-NONE;
  /* Check for unvoiced based on the bpvc */
  if (vr_max (bpvc, N_FBANDS, NULL)<=BPVC_LO)
    vFlag=V_NONE;
  /* Clear bandpass voicing if unvoiced */
  if (vFlag==V_NONE) vr_set (BPVC_UV, bpvc, N_FBANDS);
  /* Jitter: make sure pitch path is not smooth if lowest band voicing strength is weak */
  if (pCorr<JIT_COR && abs(p−p0)<JIT_P){
    warn_pr ("pitch_ana", "Phase jitter in use");
    if (p>p0 ||(p0−JIT_P<PITCH_MIN))
      p=p0+JIT_P;
    else
      p=p0−JIT_P;
  }
  /* The output values */
  *pitch =p;
  *p_corr=pCorr;
  min(vFlag, V_STRONG)
```

(13) compute voicing levels for each 20-sample sub-frame:

fpar[k].vc=min(vFlag, V_STRONG))

pitch_avg as decaying fpar[k].pitch fpar[k].vc interpolate fpar[k].pitch interpolate

(14) mode determination:

if there is no speech activity, classify as UV_MODE

```
define N=min(par[0].vc+par[4].vc, par[4].vc+par[8].vc)
  define i=max(par[4].vc, par[8].vc)
    if (N>=4 && i>=3)
    { if (!xFlag && par[0].pitch to par[8].pitch ratio varies>50%)
        mode=WV_MODE;
    else mode=SV_MODE;
    }
  else if (N>=1) mode=WV_MODE;
  else mode=UV_MODE;
```

Note that N>=4 && i>=3 indicates strong voicing. Contrarily, (!xFlag && par[0].pitch to par[8].pitch ratio varies more than 50%) indicates unreliable pitch estimation because the prior frame was SV_MODE (!xFlag) but the pitch estimate still varied widely across the pitch frame (ratio par[8].pitch/par[0].pitch or its reciprocal exceeds 1.5). Thus the preferred embodiment takes the occurrence of both strong voicing and unreliable pitch estimation to make a WV_MODE decision, whereas strong voicing with reliable pitch estimation yields SV_MODE. Without strong voicing the preferred embodiment makes the decision between WV_MODE and UV_MODE based on a weak voicing threshold (N>=1).

(15) set xFlag to indicate CELP or MELP frame

(16) parameter quantization according to classification.

Coding

Encode the frames with speech activity according to the foregoing mode classification as previously described:

(a) SV_MODE frames coded with parametric coding (MELP) using an excitation made of a pitch waveform plus noise shaped to the bandpass voicing levels.

(b) WV_MODE frames coded with CELP using pitch-prediction filter plus sparse codebook excitation. That is, 80-sample target excitation vector x(n) is filtered by $(1-gD^{p})$ where p is the (integer) pitch estimate, D is a one sample delay, and g is a gain. Thus the filtered target excitation vector is w(n)=x(n)−g*x(n−p). And w(n) is coded with the sparse codebook which has at most a single pulse in each 20-sample subset, so two pulses with corresponding signs are jointly coded with 11 bits. 44 bits then codes all 8 pulses in a 160-sample frame target excitation vector.

(c) UV_MODE frames coded with CELP using an excitation from a stochastic codebook.

In more detail: process a frame as follows (1) for each 20-sample subframe apply the corresponding LPC analysis filter to the input speech frame plus possibly extending into the following frame by centering at the subframe end an interval of N+19 samples where N is either the corresponding subframe fpar[k].pitch rounded to nearest integer for voiced subframes or 40 for an unvoiced subframe. Thus the intervals will range from 37 to 151 samples in length. This analysis filtering yields an LP residual for each of the eight sub-frames; these residuals possibly have differing sample lengths.

(2) extract a waveform from each residual by an N-point discrete Fourier transform. Note that the Fourier coefficients thus correspond to the amplitudes of the pitch frequency and its harmonics for the subframe. The gain parameter is the energy of the residual divided by N, which is just the average squared sample amplitude. Because the Fourier transform is complex symmetric (due to the speech being real), only the harmonics up to N/2 need be retained. Also, the dc (zeroth harmonic) can be ignored.

(3) encode without phase alignment or zero phase equalization. Alternative preferred embodiment hybrid coders use phase alignment for MELP and/or zero phase equalization for CELP, as detailed in sections below.

Alignment phase

Preferred embodiment hybrid coders may include estimating and encoding "alignment phase" which can be used in the parametric decoder (e.g. MELP) to preserve time-synchrony between the input speech and the synthesized speech. This avoids any artifacts due to phase discontinuity at the interface with synthesized speech from the waveform decoder (e.g., CELP) which inherently preserves time-synchrony. In particular, for a strongly-voiced (sub)frame which invokes MELP coding, a pitch-period length interval of the residual centered at the end of the (sub)frame ideally includes a single sharp pulse, and the alignment phase, $\phi(A)$, is the added phase in the frequency domain which corresponds to time-shifting the pulse to the beginning of the pitch-period length residual interval. This alignment phase provides time-synchrony because the MELP periodic waveform codebook consists of quantized waveforms with Fourier amplitudes only (zero-phase) which corresponds to a pulse at the beginning of an interval. Thus the (periodic portion of the) quantized excitation can be synthesized from the codebook entry together with the gain, pitch-period, and alignment phase. Alternatively, the alignment phase may be interpreted as the position of the sharp pulse in the pitch-period length residual interval.

Employing the alignment-phase in parametric-coder synthesis formulas can significantly reduce switching artifacts between parametric and waveform coders. Preferred embodiments may implement a 4 kb/s hybrid CELP/MELP coder with preferred embodiment estimation and encoding of the alignment-phase $\phi(A)$ to maintain time-synchrony between input speech and MELP-synthesized speech. FIGS. 4*a*–4*d* illustrate preferred embodiment estimations of the alignment phase, $\phi(A)$, which employs an intermediate waveform alignment and associated phase, $\phi(a)$, in addition to a phase 4(0) which relates the intermediate aligned waveform to the zero-phase (codebook) waveform. In particular, $\phi(A)=\phi(0)-\phi(a)$. The advantage of using this intermediate alignment lies in the accuracy of the intermediate alignment and phase $\phi(a)$ together with the accuracy of $\phi(0)$. In fact, the intermediate alignment is just an alignment to the preceding sub-frame's aligned waveform (which has been smoothed over its preceding sub-frames' aligned waveforms); thus the alignment matches a waveform to a similarly-shaped and stable waveform. Plus the phase $\phi(0)$ relating the aligned waveform with a zero-phase version will be almost constant because the smoothed aligned waveform and the zero-phase version waveform both have minimal variation from sub-frame to sub-frame.

In more detail, for each of the eight 20-sample sub-frames (k=1, . . . , 8) of a frame determine a voicing level (fpar[k].vc) and a pitch (fpar[k].pitch) plus define an interval N[k] equal to the nearest integer of the pitch or equal to 40 for voicing level 0.

Figure 4A:
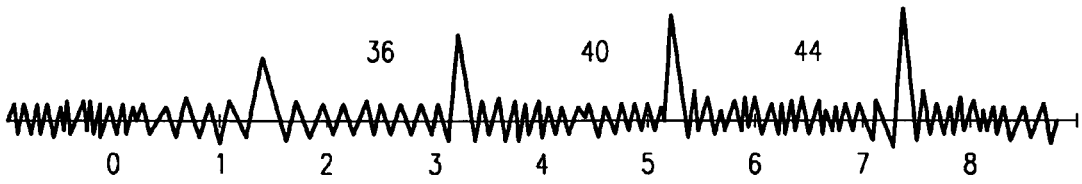
FIGS. 4*a*–4*d* are examples for phase alignment.

Next, for each sub-frame of the look-ahead speech apply standard LP analysis to an interval of length N[k] centered at the k-th sub-frame end to obtain an LP residual of length N[k]. Note that taking a slightly larger interval and selecting a subinterval of length N[k] permits selection of a residual which has its energy away from the interval boundaries and avoids discontinuities. As an illustrative simplified example, FIG. 4*a* shows a segment of residual with sub-frames labeled 0 (prior frame end) to 8 and four pulses with a pitch period increasing from about 36 samples to over 44 samples.

Figure 4B:
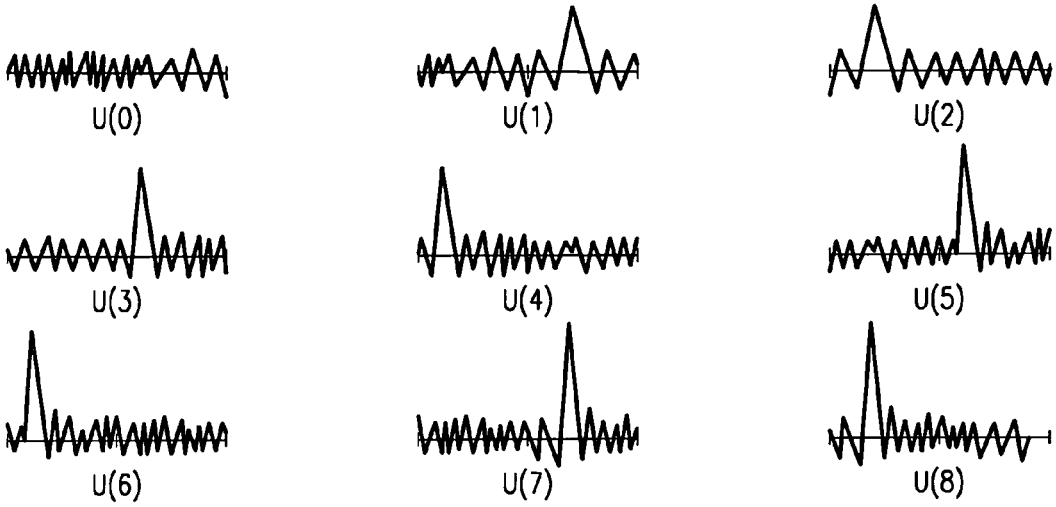
Figure 4C:
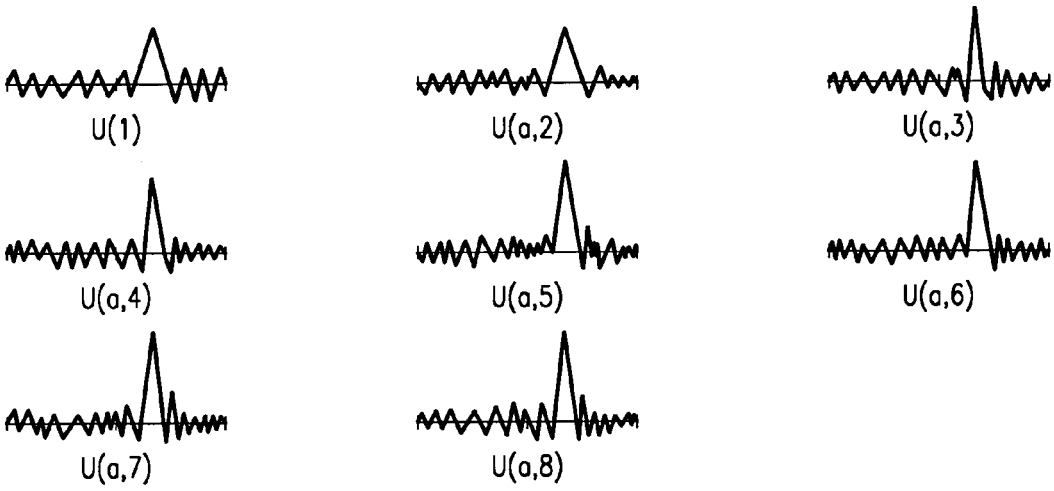
Figure 4D:
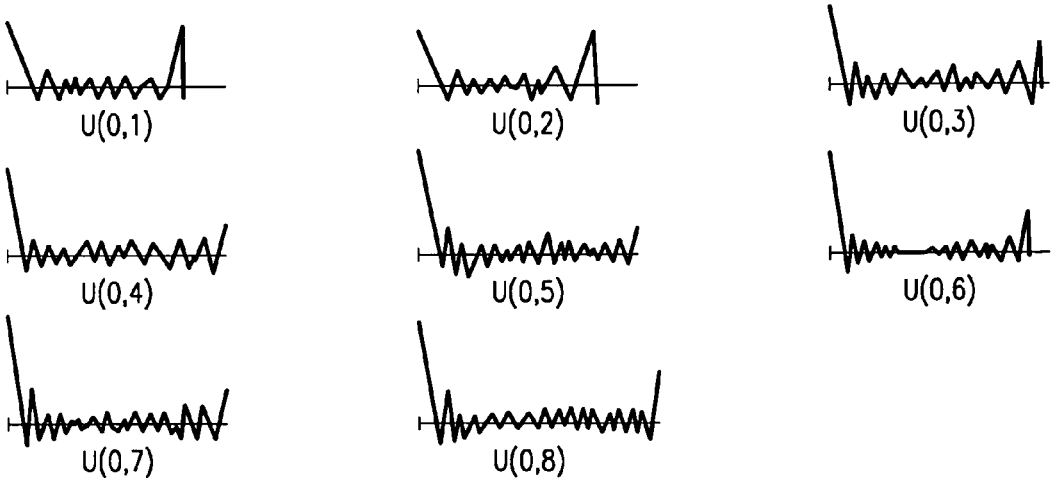

FIG. 4*b* shows the extracted pitch-period length residual for each of the subframes. A DFT with N[k] points transforms each extracted residual into a waveform in the frequency domain. This compares to one pitch period in FIG. 2*a* and FIG. 2*b*. For convenience denote both the k-th extracted waveform and its time domain version as u(k), and FIGS. 4*a*–4*c* show the time domain version for clarity.

Then successive align each u(k) with its (aligned) predecessor. Denote the k-th aligned waveform as u(a,k). Note that the first waveform after a sub-frame without voicing is the starting point for the alignment; see FIGS. 4*b*–4*c* and u(1). Perform the alignment in the frequency domain although alignment in time domain is also possible and simply finds the shift of the k-th waveform that maximizes the cross-correlation with the aligned (k−1)-th waveform. In the frequency domain to align waveform u(k) to waveform smoothed u(a,k−1), a linear phase $\phi(a,k)$ is added to waveform u(k); that is, the phase of the n-th Fourier coefficient is increased (modulo $2\pi$) by $n\phi(a,k)$. The phase $\phi(a,k)$ can be interpreted as a differential alignment phase of waveform u(k) with respect to aligned waveform u(a,k−1).

Smooth the waveforms u(a,k) along index k by (weighted) averaging over sequences of ks; for example, the weights can decay linearly over three or four waveforms, or decay quadratically, exponentially, etc. As FIG. 4*c* shows, the u(a,k) possess similarity, and the smoothing effectively suppresses noise and jitter of the individual u(a,k).

In a system in which the phase of waveforms u(a,k) is transmitted, the series $\{\phi(a,k)\}$ suffices to synthesize time-synchronous speech. When the phase of waveforms u(a,k) is not transmitted, $\{\phi(a,k)\}$ is not sufficient. This is because, in general, zero-phase waveforms u(0,k) are not aligned to waveforms u(a,k). Note that the zero-phase waveforms u(0,k) are derived in the frequency domain by making the phase at each frequency equal to 0. That is, the real and imaginary parts of each X[n] are replaced by the magnitude |X[n]| with zero imaginary part. This corresponds in the time domain to $a_n\cos(nt)+b_n\sin(nt)$ replaced by $\sqrt{(a_n^2+b_n^2)}\cos(nt)$ which essentially sharpens the pulse and shifts the maximum to t=0.

In some preferred embodiment systems, the phase of u(a,k) is not coded. Therefore determine the phase $\phi(0,k)$ aligning u(0,k) to u(a,k). The phase $\phi(0,k)$ is computed as a linear phase which needs to be added to waveform u(0,k) to maximize its correlation with u(a,k). And using smoothed u(a,k) eliminates noise in this determination. The overall encoded alignment-phase $\phi(A,k)$ is then calculated as $\phi(A,k)=\phi(0,k)-\phi(a,k)$. Conceptually, adding the alignment-phase $\phi(A,k)$ to the encoded waveform u(0,k) approximates u(k), the waveform ideally synthesized by the decoder.

Note that, by directly aligning waveform u(0,k) to waveform u(k), it is possible to calculate $\phi(A,k)$ without computing $\phi(a,k)$. However, the resulting series $\{\phi(A,k)\}$ may contain many phase-estimation errors due to the noisy character of waveforms u(k) (the noise is reduced in u(a,k) by smoothing the waveform's evolution). The preferred embodiments separately estimate phases $\phi(a,k)$ and $\phi(0,k)$; this experimentally appears to improve performance.

The fundamental frequency $\omega(t)$ is the derivative of the fundamental phase $\phi(t)$, so that $\phi(t)$ is the integral of $\omega(t)$. Alignment-phase $\phi(A,t)$ is akin to fundamental phase $\phi(t)$ but the two are not equivalent. The fundamental phase $\phi(t)$ can be interpreted as the phase of the first (fundamental) harmonic, while the alignment-phase $\phi(A,t)$ is considered independently of the first-harmonic phase. For a particular time instance, the alignment-phase specifies the desired phase (time-shift) within a given waveform. As long as the waveforms to which the alignment-phase refers to are aligned (like, for example, waveforms $\{u(a,k)\}$), the variation of the alignment-phase over time determines the signal fundamental frequency in a similar way as the variation of the fundamental phase does, that is, $\omega(t)$ is the derivative of $\phi(A,t)$.

Indeed, for an ideal pulse the n-th Fourier coefficient has a phase $n\phi$ where $\phi$, is the fundamental phase. Contrarily, for a non-ideal pulse the n-th Fourier coefficient has a phase $\phi_n$ which need not be equal to $n\phi_1$. Thus computing $\phi_1$ estimates the fundamental phase, whereas the alignment phase $\phi(A)$ minimizes a (weighted) sum over n of $(\phi_n-n\phi(A) \bmod 2\pi)^2$.

Estimate the fundamental frequency $\omega(k)$ (pitch frequency) and the alignment phase $\phi(A,k)$ (by $\phi(A,k)=\phi(0,k)-\phi(a,k)$ for each k-th frame (sub-frame). The frequency $\omega(k)$ and the phase $\phi(A,k)$ are quantized and their intermediate (in-frame sample-by-sample) values are interpolated. In order to match the quantized values $q\omega(k-1)$, $q\omega(k)$, $q\phi(A,k-1)$, and $q\phi(A,k)$, the order of the interpolation polynomial for $\phi(A)$ must be at least three (cubic) which means a quadratic interpolation for $\omega$. The interpolation polynomials within a frame can be written as $$\phi(A,t)=a_3t^3+a_2t^2+a_1t+a_0$$

$$\omega(t)=3a_3t^2+2a_2t+a_2$$

with $0<t\leqq T$ where T is the length of a frame. Calculate the polynomial coefficients as $$a_3=(\omega(k-1)+\omega(k))/T^2-2(\phi(A,k)-\phi(A,k-1))/T^3$$

$$a_2=3(\phi(A,k)-\phi(A,k-1))/T^2-(2\omega(k-1)+\omega(k))/T$$

$$a_1=\omega(k-1)$$

$$a_0=\phi(A,k-1)$$

Note that before the foregoing formulas are used, phases $\phi(A,k-1)$ and $\phi(A,k)$ must be properly unwrapped (multiples of 27 ambiguities in phases). The unwrapping can be applied to the phase difference defined by $$\phi(d,k)=\phi(A,k)-\phi(A,k-1).$$

The unwrapped phase difference $\phi^{\hat{o}}(d,k)$ can be calculated as $$\phi^{\hat{o}}(d,k)=\phi(P,k)-\min|\phi(P,k)-\phi(d,k)\pm 2\pi n|$$

where $\phi(P,k)$ specifies a predicted value of $\phi(A,k)$ using an integration of an average of $\omega$ at the endpoints:

$$\phi(P,k)=\phi(A,k-1)+T(\omega(k-1)+\omega(k))/2.$$

The polynomial coefficients $a_3$ and $a_2$ can be calculated as $$a_3=(\omega(k-1)+\omega(k))/T^2-2\phi^{\hat{o}}(d,k)/T^3$$

$$a_2=3\phi^{\hat{o}}(d,k)/T^2-(2\omega(k-1)+\omega(k))/T$$

Figure 5:
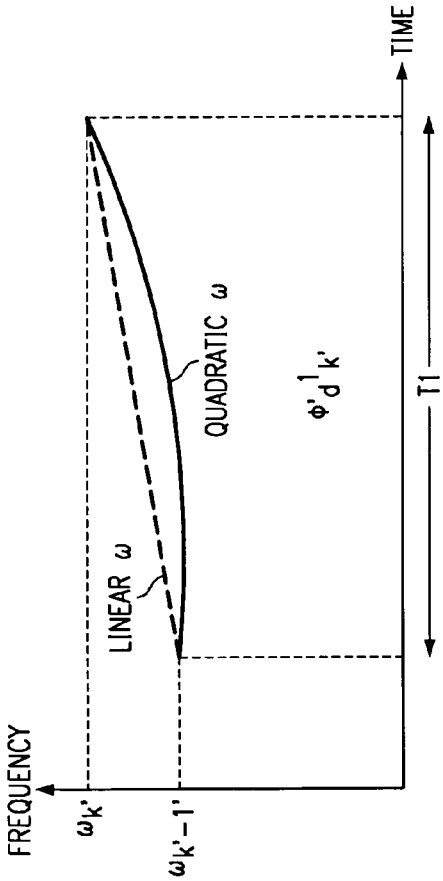
FIG. 5 shows interpolation for phase and frequency.

FIG. 5 presents a graphic interpretation of the $\phi(A)$ and $\omega$ interpolation. The solid line is an example of quadratically interpolated $\omega$. The area under the solid line represents the (unwrapped) phase difference $\phi^{\hat{o}}(d,k)$. The dashed line represents linear interpolation of $\omega$.

In MELP, the LP excitation is generated as a sum of noisy and periodic excitations. The periodic part of the LP excitation is synthesized based on the interpolated Fourier coefficients (waveform) computed from the LP residual. Fourier synthesis is applied to spectra in which the Fourier coefficients are placed at the harmonic frequencies derived from the interpolated fundamental (first harmonic) frequency. This synthesis is described by the formula $$x[t]=\Sigma X_t[k]e^{jk\phi(t)}$$

Where the $X_t[k]$ are the Fourier coefficients interpolated for time t. The phase $\phi(n)$ is determined by the fundamental frequency $\omega(t)$ as $$\phi(t)=\phi(t-1)+\omega(t)$$

The fundamental frequency$\omega(t)$ could be calculated by linear interpolation of values (reciprocal of pitch period) encoded at the boundaries of the frame (or sub-frame). However, in preferred embodiment synthesis with the alignment-phase $\phi(A)$, interpolate $\omega$ quadratically so that the phase $\phi(t)$ is equal to $\phi(A,k)$ at the end of the k-th frame. The polynomial coefficients of the quadratic interpolation are calculated based on estimated fundamental frequency and alignment-phase at frame (sub-frame) boundaries as described in prior paragraphs.

The fundamental phase $\phi(t)$ being equal to $\phi(A,k)$ at a frame boundary, the synthesized speech is time-synchronized with the input speech provided that no errors are made in the $\phi(A)$ estimation. The synchronization is strongest at frame boundaries and may be weaker within a frame. This is not a problem as switching between the parametric and waveform coders is restricted to frame boundaries.

The alignment-phase $\phi(A)$ can be encoded for each frame directly with a uniform quantizer between $-\pi$ and $\pi$. For higher resolution and better performance in frame erasures, code the difference between predicted and estimated value of $\phi(A)$. Compute the predicted alignment-phase $\phi\sim(P,k)$ as $$\phi\sim(P,k)=\phi\sim(A,k-1)+(\omega\sim(k-1)+\omega\sim(k))T/2$$

where T is the length of a frame, and ~ denotes decoded parameters. After suitable phase unwrapping, encode $$\phi(D,k)=\phi\sim(P,k)-\phi(A,k)$$

so that $$\phi\sim(A,k)=\phi\sim(P,k)-\phi\sim(D,k)$$

The phase $\phi(D,k)$ can be coded with a uniform quantizer of range $-\pi/4$ to $\pi/4$ which corresponds to a two-bit saving with respect to a full range quantizer ($-\pi$to $\pi$) with the same precision. The preferred embodiments' 4 kb/s MELP implementation has sufficient bits to encode $\phi(D,k)$ with six bits for the full range from $-\pi$ to $\pi$.

The sample-by-sample trajectory of the fundamental frequency $\omega$ is calculated from the fundamental-frequency and alignment-phase values encoded at frame boundaries, $\omega(k)$ and $\phi(A,k)$, respectively. If the $\omega$ trajectory includes large variations, an audible distortion may be perceived. It is therefore important to maintain a smooth evolution of $\omega$ (within a frame and between frames). Within a frame, the most "smooth" trajectory of the fundamental frequency is obtained by linear interpolation of $\omega$.

The evolution of $\omega$ can be controlled by adjusting $\omega(k)$ and (A,k). Linear evolution of $\omega$ can be obtained by modifying $\omega(k)$ so that $$\omega\sim(d,k)=(\omega(k-1)+\omega(k))T/2$$

For that case quadratic interpolation of $\omega$ reduces to linear interpolation. This may lead, however, to oscillations of $\omega$ between frames; for a constant estimate of the fundamental frequency and an initial $\omega$ mismatch, the so values at frame boundaries would oscillate between a larger and smaller value than the estimate. Adjusting the alignment-phase $\phi(A,k)$ to produce within-frame linear $\omega$ trajectory would result in lost time-synchrony.

Perform limited modification of both, $\omega(k)$ and $\phi(A,k)$, smoothing the interpolated $\omega$trajectory with time-synchrony preserved. Consider the $\omega$ trajectory "smoother" if the area between linear and quadratic interpolation of $\omega$ is smaller (area between the dashed and the solid line in FIG. 5). This area represents the difference between predicted phase $\phi(P,k)$ and (unwrapped) estimated phase $\phi(A,k)$, and is equal to the encoded phase $\phi(D,k)$.

In one preferred embodiment, first encode $\omega(k)$ and then choose the one of its neighboring quantization levels for which $\phi(D,k)$ is reduced. Then encode $\phi(D,k)$ and again choose the one of its neighboring quantization levels for which $\phi(d,k)$ is reduced further.

In other tested joint $\omega(k)$ and $\phi(A,k)$ quantization preferred embodiments, encode the fundamental frequency $\omega(k)$ minimizing the alignment-phase quantization error $\phi\sim(A,k)-\phi(A,k)$.

In the frame for which a parametric coder is used after a waveform coder, coded fundamental frequency and alignment phase from the last frame are not available. The phase at the beginning of the frame may be decoded as $$\phi\sim(A,k)-\phi 1)=\phi\sim(A,k)-\omega\sim(k)T$$

with the fundamental frequency set to $$\omega\sim(k-1)=\omega\sim(k).$$

In the joint quantization of fundamental frequency and alignment-phase, first encode $\omega(k)$ and $\phi(k)$ and then choose their neighboring quantization levels for which the quantization error of $\phi\sim(A,k-1)$ with respect to estimated $\phi(A,k-1)$ is reduced.

Some preferred embodiments use the phase alignment in a parametric coder, phase alignment estimation, and phase alignment quantization. Some preferred embodiments use a joint quantization of the fundamental frequency with the phase alignment.

Decoding with alignment phase

The decoding using alignment phase can be summarized as follows (with the quantizations by the codebooks ignored for clarity). For time t between the ends of subframes k and k+1 (that is, time t is in subframe k+1), the synthesized periodic part of the excitation if the phase were coded would be a sum over harmonics:

$$x(t)=\Sigma X_t(n)e^{jn\phi(t)}$$

with $X_t(n)$ the n-th Fourier coefficient interpolated for time t from $X_k(n)$ and $X_{k+1}(n)$ where $X_k(n)$ is the n-th Fourier coefficient of residual u(k) and $X_{k+1}(n)$ is the n-th Fourier coefficient of residual u(k+1) and $\phi(t)$ is the fundamental phase interpolated for time t from $\phi(k)$ and $\phi(k+1)$ where $\phi(k)$ is the fundamental phase derived from u(k) and $\phi(k+1)$ and the fundamental phase derived from u(k+1).

However, for the preferred embodiments which code only the magnitudes of the Fourier coefficients, only $|X_t(n)|$ is available and is interpolated for time t from $|X_k(n)|$ and $|X_{k+1}(n)|$ which derive from u(0,k) and u(0,k+1), respectively. In this case the synthesized periodic portion of the excitation would be:

$$x(t)=\Sigma|X_t(n)|e^{jn\phi(A,t)}$$

where $\phi(A,t)$ is the alignment phase interpolated for time t from alignment phases $\phi(A,k)$ and $\phi(A,k+1)$.

Overall use of alignment phase fits into the previously-described preferred embodiments frame processing as follows:

(1) optionally, filter input speech to suppress noise.

(2) apply LP analysis to windowed 200-sample interval to obtain gain and linear prediction coefficients (linear spectral frequencies); interpolate to each 20-sample sub-frame.

(3) for 132-sample residual measure peakiness by ratio of average squared sample value divided square of average sample absolute value; the peakiness is part of the voicing level decision.

(4) find pitch period and bandpass voicing by cross-correlations of 44-sample intervals with one end at a frame end, interpolate for sub-frame ends. The correlation level is part of the voicing decision.

(5) frame classification as detailed above (6) quantize LP parameters at each frame end with codebook (7) Parametric encoding:

(a) at each sub-frame end extract a residual of pitch-period length (FIGS. 4*a*–4*b*).

(b) DFT for waveform called WFr, WFi for real and imaginary (c) smooth prior aligned waveforms: u(a,k−1) (FIG. 4*c*)

(d) align u(k) with u(a,k−1) by correlations in frequency domain: defines $\phi$(a,k) (FIG. 4*c* next panel); this is u(a,k).

(e) lowpass filter the Fourier coefficients WFr, WFi to separate into the periodic pulse portion PWr, PWi plus the noise portion NWr, NWi for MELP excitation codebooks.

(f) define zero-phase version u(0,k) of waveform by amplitude (magnitude) only of Fourier coefficients PWr, PWi as par[k].PWr.

(g) align par[k].PWr to PWr, PWi; this is phase $\phi$(0,k)

(h) quantize gain (i) quantize pitch and alignment phase using codebooks.

(j) interpolate alignment phase and pitch with cubic interpolation.

(k) quantize bandpass voicing.

(l) quantize PW amplitudes.

(8) CELP encoding: extract 20-sample residuals at each sub-frame (a) if (UV_MODE) set zero-phase equalization filter coefficients=0.0; elseif (WV_MODE) determine zero-phase equalization filter coefficients with low-pass filtered Fourier coefficients PWr[k] plus prior peak position; has output filter coefficients and phase for shift plus output of peak position.

(b) apply zero-phase equalization filter: speech to mod_sp; use mod_sp (if phase-equalization) or sup_sp (if no phase-equalization):

(c) perceptual filter input speech (d) LPC residual (e)<=UV_MODE excitation, target, stochastic codebook search (f) pitch refinement for WV_MODE (g) WV_MODE pulse excitation codebook search

(10) save parameters for next frame and update filter memories if SV_MODE

(11) transmit coded quantized parameters, codebook indices, etc.

The decoder looks up in codebooks, interpolates, etc. for the excitation synthesis and inverse filtering to synthesize speech.

Zero-phase equalization

Waveform-matching coders (e.g. CELP) encode speech based on an error between the input (target) and a synthesized signal. These coders preserve the shape of the original waveform and thus the signal phase present in the coder input. In contrast, parameter coders (e.g. MELP) encode speech based on an error between parameters extracted from input speech and parameters used to synthesize output speech. Often (e.g., in MELP), the signal phase component is not encoded and thus the shape of the encoded waveform is changed.

The preferred embodiment hybrid coders switch between a parametric (MELP) coder and a waveform (CELP) coder depending on speech characteristics. However, audible distortions arise when a signal with an encoded phase component is immediately followed by a signal for which the phase is not coded. Also, abrupt changes in the synthesized signal waveform-shape result in annoying artifacts.

Figure 6A:
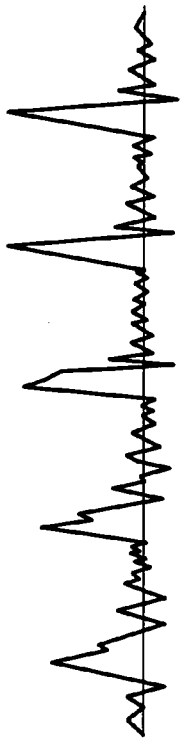
FIGS. 6*a*–6*b* illustrate zero-phase equalization.
Figure 6B:
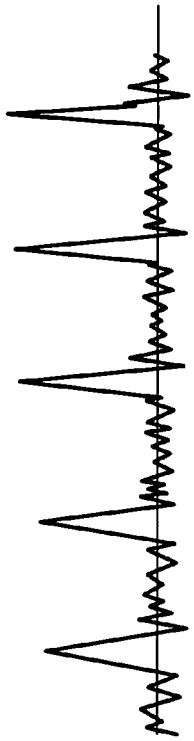

To facilitate arbitrary switching between a waveform coder and a parametric coder, preferred embodiments may remove the phase component from the target signal for the waveform (CELP) coder. The target signal is used by the waveform coder in its signal analysis; by removing the phase component from the target, the preferred embodiments make the target signal more similar to the signal synthesized by the parametric coder, thereby limiting switching artifacts. Indeed, FIG. 6*a* illustrates an example of a residual for a weakly-voiced frame in the lefthand portion and a residual for a strongly-voiced frame in the righthand portion. FIG. 6*b* illustrates the removal of the phase components of the weakly-voiced residual, and the weakly-voiced residual now appears more similar to the strongly-voiced residual which also had its phase components removed by the use of amplitude-only Fourier coefficients. Recall that in the foregoing MELP description the waveform Fourier coefficients X[n] (DFT of the residual) was converted to amplitude-only coefficients $|X[n]|$ for coding; and this conversion to amplitude-only sharpens the pulse in the time domain. Note that the alignment phase relates to the time synchronization of the synthesized pulse with the input speech. The zero-phase equalization for the CELP weakly-voiced frames performs a sharpening of the pulse analogous to that of the MELP's conversion to amplitude-only; the zero-phase equalization does not move the pulse and no further time synchronization is needed.

A preferred embodiment 4 kb/s hybrid CELP/MELP system, applies zero-phase equalization to the Linear Prediction (LP) residual as follows. The equalization is implemented as a time-domain filter. First, standard frame-based LP analysis is applied to input speech and the LP residual is obtained. Use frames of 20 ms (160 samples). The equalization filter coefficients are derived from the LP residual and the filter is applied to the LP residual. The speech domain signal is generated from the equalized LP residual and the estimated LP parameters.

In a frame for which the CELP coder is chosen, equalized speech is used as the target for generating synthesized speech. Equalization filter coefficients are derived from pitch-length segments of the LP residual. The pitch values vary from about 2.5 ms to over 16 ms (i.e., 18 to 132 samples). The pitch-length waveforms are aligned in the frequency domain and smoothed over time. The smoothed pitch-waveforms are circularly shifted so that the waveform energy maxima are in the middle. The filter coefficients are generated by extending the pitch-waveforms with zeros so that the middle of the waveform corresponds to the middle filter coefficient. The number of added zeros is such that the length of the equalization filter is equal to maximum pitch-length. With this approach, no delay is observed between the original and zero-phase-equalized signal. The filter coefficients are calculated once per 20 ms (160 samples) frame and interpolated for each 2.5 ms (20 samples) sub-frame. For unvoiced frames, the filter coefficients are set to an impulse so that the filtering has no effect in unvoiced regions (except for the unvoiced frame for which the filter is interpolated from non-impulse coefficients). The filter coefficients are normalized, i.e., the gain of the filter is set to one.

Generally, the zero-phase equalized speech has a property of being more "peaky" than the original. For the voiced part of speech encoded with a codebook containing fixed number of pulses (e.g. algebraic codebook), the reconstructed-signal SNR was observed to increase when the zero-phase equalization was used. Thus the preferred embodiment zero-phase equalization could be useful as a preprocessing tool to enhance performance of some CELP-based coders.

An alternative preferred embodiment applies the zero-phase equalization directly on speech rather than on the LP residual.

CELP coefficient interpolation

At bit rates from 6 to 16 kb/s, CELP coders provide high-quality output speech. However, at lower data rates, such as 4 kb/s, there is a significant drop in CELP speech quality. CELP coders, like other Analysis-by-Synthesis Linear Predictive coders, encode a set of speech samples (referred to as a subframe) as a vector excitation sequence to a linear synthesis filter. The linear prediction (LP) filter describes the spectral envelope of the speech signal, and is quantized and transmitted for each speech frame (one or more subframes) over the communication channel, so that both encoder and decoder can use the same filter coefficients. The excitation vector is determined by an exhaustive search of possible candidates, using an analysis-by-synthesis procedure to find the synthetic speech signal that best matches the input speech. The index of the selected excitation vector is encoded and transmitted over the channel.

At low data rates, the excitation vector size ("subframe") is typically increased to improve coding efficiency. For example, high-rate CELP coders may use 2.5 or 5 ms (20 or 40 samples) subframes, while a 4 kb/s coder may use a 10 ms (80 samples) subframe. Unfortunately, in the standard CELP coding algorithm the LP filter coefficients must be held constant within each subframe; otherwise the complexity of the encoding process is greatly increased. Since the LP filter can change dramatically from frame to frame while tracking the input speech spectrum, switching artifacts can be introduced at subframe boundaries. These artifacts are not present in the LP residual signal generated with 2.5 ms LP subframes, due to more frequent interpolation of the LP coefficients. In a 10 ms subframe CELP coder, the excitation vectors must be selected to compensate for these switching artifacts rather than to match the true underlying speech excitation signal, reducing coding efficiency and degrading speech quality.

To overcome this switching problem, preferred embodiment CELP coders may have long excitation subframes but more frequent LP filter coefficient interpolation. This CELP synthesizer eliminates switching artifacts due to insufficient LP coefficient interpolation. For example, preferred embodiments may use an excitation subframe size of 10 ms (80 samples), but with LP filter interpolation every 2.5 ms (20 samples). The CELP analysis uses a version of analysis-by-synthesis that includes the preferred embodiment synthesizer structure, but maintains comparable complexity to traditional analysis algorithms. This analysis approach is an extension of the known "target vector" approach. Rather than directly encoding the speech signal, it is useful to compute a target excitation vector for encoding. This target is defined as the vector that will drive the synthesis LP filter to produce the current frame of the speech signal. This target excitation is similar to the LP residual signal generated by inverse filtering the original speech; however, it uses the filter memories from the synthetic instead of original speech.

The target vector method of CELP search can be summarized as follows:

1. Compute the target excitation vector for the current subframe using LP coefficients for the subframe.
2. Search candidate excitation vectors using analysis-by-synthesis for the current subframe, by minimizing the error between the candidate excitation passed through the LP synthesis filter and the target excitation passed through the LP synthesis filter.
3. Synthesize speech for the current subframe using the chosen excitation vector passed through the LP synthesis filter.

The preferred embodiment CELP analysis extends this target excitation vector approach to support more frequent interpolation of the LP filter coefficients. This eliminates switching artifacts due to insufficient LP coefficient interpolation, without significantly increasing the complexity of the core CELP excitation search in step 2) above. The preferred embodiment method is:

1. Compute the target excitation vector for the current excitation subframe using frequently interpolated LP coefficients (multiple sets within a subframe).
2. Search candidate excitation vectors using analysis-by-synthesis for the current subframe, by minimizing the error between the excitation passed through the LP synthesis filter and the target excitation passed through the LP synthesis filter. For both signals, use the constant LP coefficients corresponding to the center of the current subframe.
3. Synthesize speech for the current subframe using the chosen excitation vector through the frequently-interpolated LP synthesis filter. With this method, we maintain the key feature of analysis-by-synthesis since the codebook search uses the target excitation vector corresponding to the full, frequently-interpolated, synthesis procedure. Therefore, a correct match of the candidate excitation to the target excitation will produce synthetic speech that matches the input speech signal. In addition, we maintain low complexity by using a simplified (time-invariant) LP filter during the core codebook search (step 2). The fully correct analysis-by-synthesis would require the use of a time-varying LP filter within the code-book search, which would result in a significant complexity increase. Our reduced-complexity method has the effect of using an approximate weighting function within the search. Overall, the benefit of frequent LP interpolation in the CELP synthesizer easily outweighs the disadvantage of the weighting approximation.

Features of this coder include:

Two speech modes: voiced and unvoiced

Unvoiced mode uses stochastic excitation codebook

Voiced mode uses sparse pulse codebook 20 ms frame size, 10 ms subframe size, 2.5 ms LPC subframe size Perceptual weighting applied in codebook search Preferred embodiments may implement this method independently of the foregoing hybrid coder preferred embodiments. This method can also be used in other forms of LP coding, including methods that use transform coding of the excitation signal such as Transform Predictive Coding (TPC) or Transform Coded Excitation (TCX).

Modifications

The preferred embodiments can be modified in various ways (such as varying frame size, subframe partitioning, window sizes, number of subbands, thresholds, etc.) while retaining the features of

- Hybrid with frame classification of UV, WV, SV with WV definition correlated with pitch predictor usage in CELP; indeed, the MELP could have full complex Fourier coefficients encoded.
- Alignment phase coded for MELP to retain time synchrony; alignment phase is a way of keeping track of what processing is done to the extracted waveform.
- Alignment phase estimation by sum of two estimates including alignment between adjacent subframes' waveforms and
- Zero-phase equalization using filter coefficients from pitch-period length waveforms.
- Interpolation of LP parameters within an excitation subframe for CELP.
- Hybrid coders:
  - MELP for SV, pitch filter plus CELP for WV, CELP for UV
  - Add alignment phase for MELP to retain time-synchrony
  - Add zero-phase equalization for WV CELP to emulate MELP amplitude-only pulse sharpening.

What is claimed is:

1. A hybrid speech encoder, comprising:

(a) a linear prediction, pitch and, voicing analyzer;

(b) a parametric encoder coupled to said analyzer; and (c) a waveform encoder coupled to said analyzer;

(d) wherein said parametric encoder encodes strongly-voiced frames and said waveform encoder encodes both unvoiced and weakly-voiced frames including a pitch-prediction filter for weakly-voiced frames.

2. The encoder of claim 1, wherein:

(a) said waveform encoder includes a sparse codebook for weakly-voiced frames and a stochastic codebook for unvoiced frames.

3. The encoder of claim 1, wherein:

(a) said analyzer, said parametric encoder, and said waveform encoder are implemented as programs on a programmable processor.

4. A hybrid speech decoder, comprising:

(a) a linear prediction synthesizer;

(b) a parametric decoder coupled to said synthesizer; and (c) a waveform decoder coupled to said synthesizer;

(d) wherein said parametric decoder decodes excitations for strongly-voiced frames and said waveform decoder decodes excitations for both unvoiced and weakly-voiced frames including a pitch predictor for weakly-voiced frames.

5. The decoder of claim 4, wherein:

(a) said waveform decoder includes a sparse codebook for weakly-voiced frames and a stochastic codebook for unvoiced frames.

6. The decoder of claim 4, wherein:

(a) said synthesizer, said parametric decoder, and said waveform decoder are implemented as programs on a programmable processor.

* * * * *